US007892077B2

(12) United States Patent
Sattler et al.

(10) Patent No.: US 7,892,077 B2
(45) Date of Patent: Feb. 22, 2011

(54) RIDGE STRIP APPARATUS

(75) Inventors: Manfred Sattler, Wohnsitz (DE); Manfred Rinklake, Wohnsitz (DE)

(73) Assignee: Lafarge Roofing Components GmbH & Co. KG, Oberursel (DE)

( * ) Notice: Subject to any disclaimer, the term of this patent is extended or adjusted under 35 U.S.C. 154(b) by 1137 days.

(21) Appl. No.: 11/065,394

(22) Filed: Feb. 24, 2005

(65) Prior Publication Data

US 2005/0166480 A1 Aug. 4, 2005

(30) Foreign Application Priority Data

Sep. 4, 2002 (DE) ..... 102 40 681

(51) Int. Cl.
*F24F 7/02* (2006.01)

(52) U.S. Cl. ..... 454/365; 454/250; 52/199; 52/43

(58) Field of Classification Search ..... 52/198, 52/95, 199, 57, 90.1, 90.2, 43, 58; 454/365, 454/366, 364, 250, 260
See application file for complete search history.

(56) References Cited

U.S. PATENT DOCUMENTS

| | | | | |
|---|---|---|---|---|
| 2,664,177 | A * | 12/1953 | Hammitt et al. | 52/92.2 |
| 4,544,593 | A * | 10/1985 | Borgert et al. | 428/80 |
| 4,573,291 | A * | 3/1986 | Hofmann | 52/43 |
| 4,664,390 | A * | 5/1987 | Houseman | 277/606 |
| 5,002,816 | A * | 3/1991 | Hofmann et al. | 428/138 |
| 5,094,041 | A * | 3/1992 | Kasner et al. | 52/57 |
| 5,122,095 | A * | 6/1992 | Wolfert | 454/365 |
| 5,332,393 | A * | 7/1994 | Godl | 454/365 |
| 5,414,964 | A * | 5/1995 | Bodycomb | 52/58 |
| 5,458,538 | A * | 10/1995 | MacLeod et al. | 454/365 |
| 5,738,581 | A * | 4/1998 | Rickert et al. | 454/365 |
| 5,740,634 | A * | 4/1998 | Schade | 52/43 |
| 6,280,856 | B1 * | 8/2001 | Andersen et al. | 428/593 |
| 6,502,353 | B2 * | 1/2003 | Hofmann | 52/58 |
| 6,865,858 | B1 * | 3/2005 | Pollard | 52/716.2 |
| 7,124,542 | B2 * | 10/2006 | Hofmann | 52/198 |
| 7,219,473 | B2 * | 5/2007 | Mantyla et al. | 52/198 |
| 2007/0251162 | A1 * | 11/2007 | Schmid | 52/95 |

FOREIGN PATENT DOCUMENTS

| | | |
|---|---|---|
| DE | 1 767 357 | 5/1958 |
| DE | 17 08 981 | 12/1971 |
| DE | 35 09 702 | 10/1985 |
| DE | 196 30 372 | 2/1998 |
| DE | 297 14 694 | 12/1998 |
| DE | 202 01 197 | 5/2002 |
| EP | 1 013 845 | 6/2000 |
| EP | 1 152 099 | 11/2001 |
| EP | 1 284 330 | 2/2003 |
| UA | 41293 C2 | 11/1992 |
| WO | WO9521975 | 8/1995 |
| WO | WO9735080 | 9/1997 |

* cited by examiner

*Primary Examiner*—Richard E Chilcot, Jr.
*Assistant Examiner*—Chi Nguyen
(74) *Attorney, Agent, or Firm*—Nils H. Ljungman & Associates

(57) ABSTRACT

Ridge strip apparatus. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

19 Claims, 3 Drawing Sheets

RIDGE STRIP APPARATUS

BACKGROUND

1. Technical Field

The present application relates to a ridge strip apparatus.

2. Background Information

Level and/or sloping ridge strips are employed in the area of the roof in order to seal the gap remaining between the level or sloping ridge batten and the roofing. This gap between level or sloping ridge batten and roofing extends on the right and the left of the level or sloping ridge batten in the longitudinal direction of the roof ridge.

The level ridge or sloping ridge strip prevents rain water, snow or insects from penetrating into the interior space of the roof. In addition, aerating and venting of the interior space of the roof is achieved preventing the development of rot and mould.

A roll-wrappable level ridge and/or sloping ridge ventilation strip is already known, which comprises a center zone adjoined on both sides by ventilation zones (DE 202 01 197 U1). These ventilation zones are developed as rib mesh extensible transversely to the level ridge and/or sloping ridge ventilation strips. They have elongated ventilation openings disposed with orientation in the longitudinal direction and developed as slits, which are distributively disposed longitudinally and transversely over a surface of the ventilation zones. A further ventilation opening is located laterally of a longitudinal interval of two ventilation openings. Of disadvantage in this known ridge ventilation strip is that the straight slits cannot form areal openings when lateral forces act upon them.

A ridge sealing strip is furthermore known, which is more variable in width, the width variability being attained through a compressible and/or extensible longitudinal undulation of the central region (DE 29714 694 U1). The wave arcs of the longitudinal undulation have at least in the region of the ridge seating aeration incisions.

Lastly, a level or sloping ridge ventilation element is also known comprising a center part which can be fastened on a level ridge or sloping ridge batten (EP 1 013 845 A1). Side parts, adjoining the center part on both sides, can be placed with their outer margin regions onto roofings. The regions between the margin regions and the center part are here implemented such that they are air-permeable. The air-permeable regions of the side parts comprise extensible filaments, which, with the aid of their extensibility, provide a reserve region such that the level or sloping ridge ventilation element is implemented such that it can be drawn out in its lateral length and/or the air-permeability can be varied.

Due to its extensibility in width, this level or sloping ridge strip has a wide application area since gaps of different size between the ridge batten and the roofing can be bridged. The extensibility is here attained thereby that the extensible filaments are comprised of an undrawn synthetic material.

OBJECT OR OBJECTS

At least one possible embodiment of the present application teaches a ridge strip apparatus.

SUMMARY

This aim is attained according to the characteristics of patent claim 1.

The invention relates to a level or sloping ridge strip comprising a deformable component, which can be placed with its outer margin region onto roofings. In order to be able to adapt this ridge strip to locally differing conditions, it is implemented such that it is extensible. The extensibility is attained thereby that the deformable component comprises two opposingly directed cut lines which are interrupted.

The advantage attained with the invention lies in particular therein that the extension of the level or sloping ridge strip takes place nearly free of tension, such that the soft butyl connection to the roofing is not stressed. In addition, a relatively large extension range of, for example, 2×30 mm is provided without additional material consumption. Moreover, even with relatively rigid materials a cut region is ensured, which makes possible the nearly tension-free bending-over of the margin regions next to the ridge batten, whereby in the case of such rigid materials resetting forces are also avoided.

A further advantage of the invention comprises that when the side margins are canted over, adequate ventilation openings automatically result, which, when the extension is utilized, are further enlarged by multiples. Simultaneously, the self-uprighting cut segments form spacers with respect to the ridge batten and nonwoven ventilation fabrics which may be present. Thereby that the closing of the ventilation channel, be that through a ridge batten, a nonwoven ventilation fabric or a ridge latch, is reliably prevented, effective ventilation is ensured.

BRIEF DESCRIPTION OF THE DRAWINGS

Embodiment examples of the invention are illustrated in the drawing and will be described in the following in further detail. In the drawing depict.

DESCRIPTION OF EMBODIMENT OR EMBODIMENTS

Figure 1:
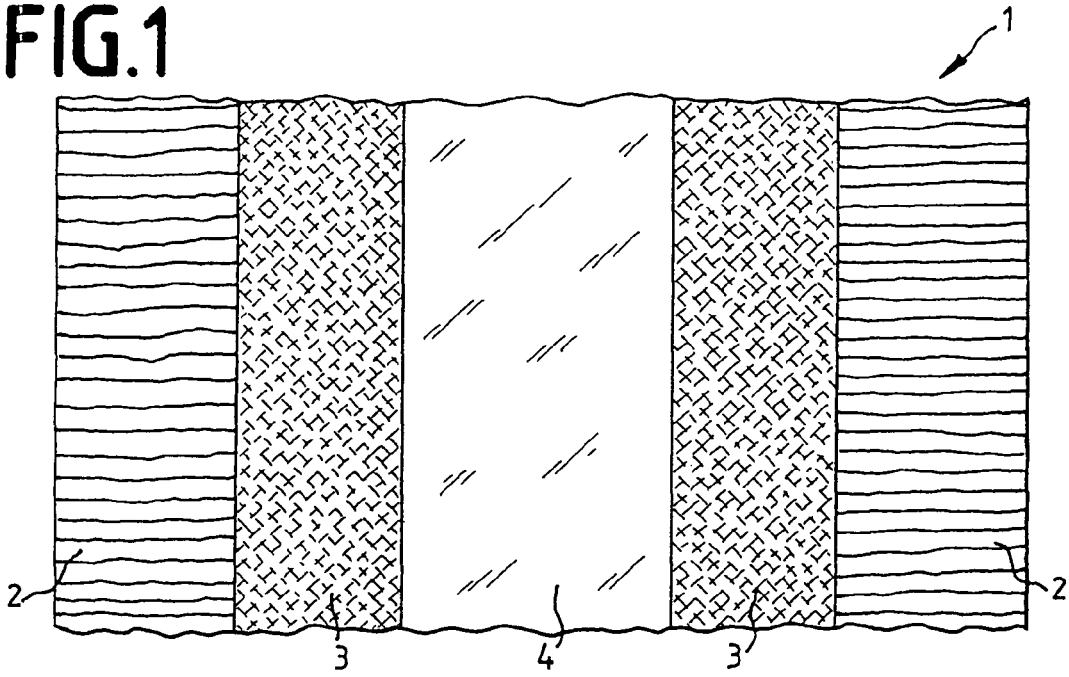
FIG. 1 a portion of a ridge strip according to the invention in top view.

FIG. 1 shows a portion of a level or sloping ridge strip 1 in top view. Superimposed on a plastically deformable component 2 is a fabric 3, on which is disposed a relatively rigid synthetic film 4.

The same level or sloping ridge strip 1 is shown again in FIG. 2, however, in a view from below. It is evident that the plastically deformable component 2 extends over the entire width of the ridge strip 1 and comprises at the ends peel-off films 5, 6 located on an adhesive strip.

Mirror-symmetrically to the center of the ridge strip 1 in the deformable component 2 are located incisions 7 to 18 in the form of sinusoidal roundings or shortened sinusoidal half-waves. These incisions 7 to 18 forming two interrupted wave-form cut lines extending in the opposing direction, make possible the extension of the ridge strip 1 in the horizontal direction.

Figure 3:
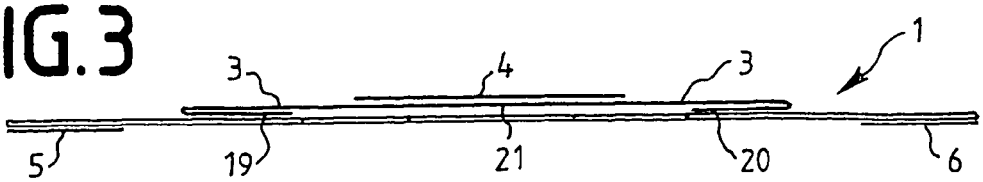
FIG. 3 the ridge strip according to FIG. 1 in side view.

FIG. 3 shows the ridge strip 1 in side view. The deformable component 2, on which is located the fabric 3, can be seen. On this fabric is disposed the synthetic material film 4. The fabric 3 is comprised at its lateral ends of two plies, the lower [folded] ply 19, 20 being shorter than the upper ply 21 and adhered to the deformable component 2. The synthetic material film 4, in turn, is adhered to the upper ply 21. When the ridge strip 1 is mounted on a ridge batten, the synthetic material film 4 and the central regions of fabric 3 and component 2 are in contact on the ridge batten. In this case the adhesive strips beneath the peel-off films 5, 6 are on the roofings. In the mounted position a view results such as is shown for example in EP 1 013 845 or FIGS. 5 and 7 of the not prior published European Patent Application EP 1 284 330 A1.

Figure 4:
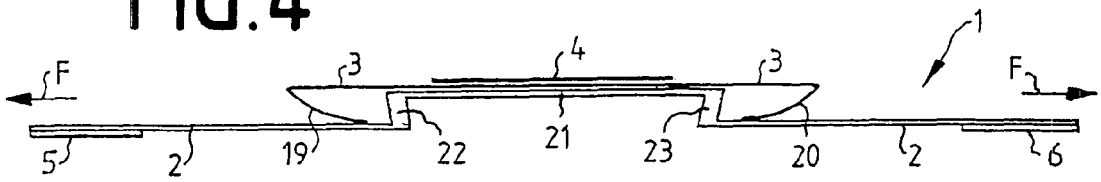
FIG. 4 the ridge strip according to FIG. 3 in a spread state.

FIG. 4 shows the same ridge strip as FIG. 3, however, after a horizontal force F has acted on it. Due to the action of this force the woven fabric 3 is folded open and the connection sites 22, 23 between two incisions are raised. As is evident in FIG. 4, the incisions, through which the connection sites 22, 23 are formed, are located at an interval from the synthetic material film 4.

Figure 2:
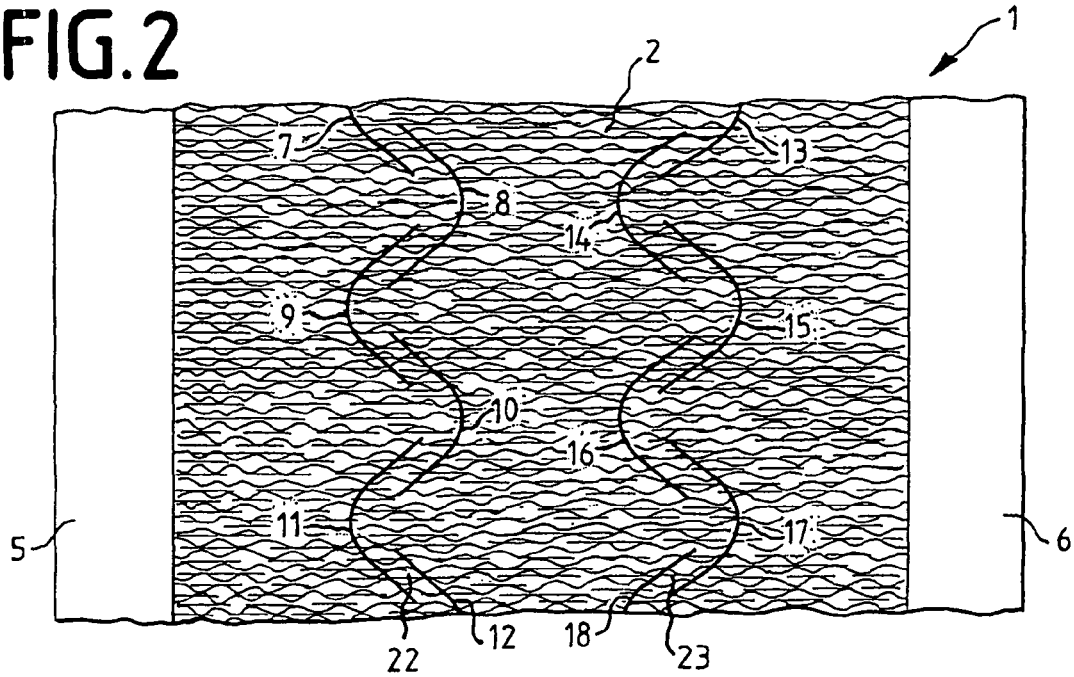
FIG. 2 the ridge strip according to FIG. 1 in a view from below.
Figure 5:
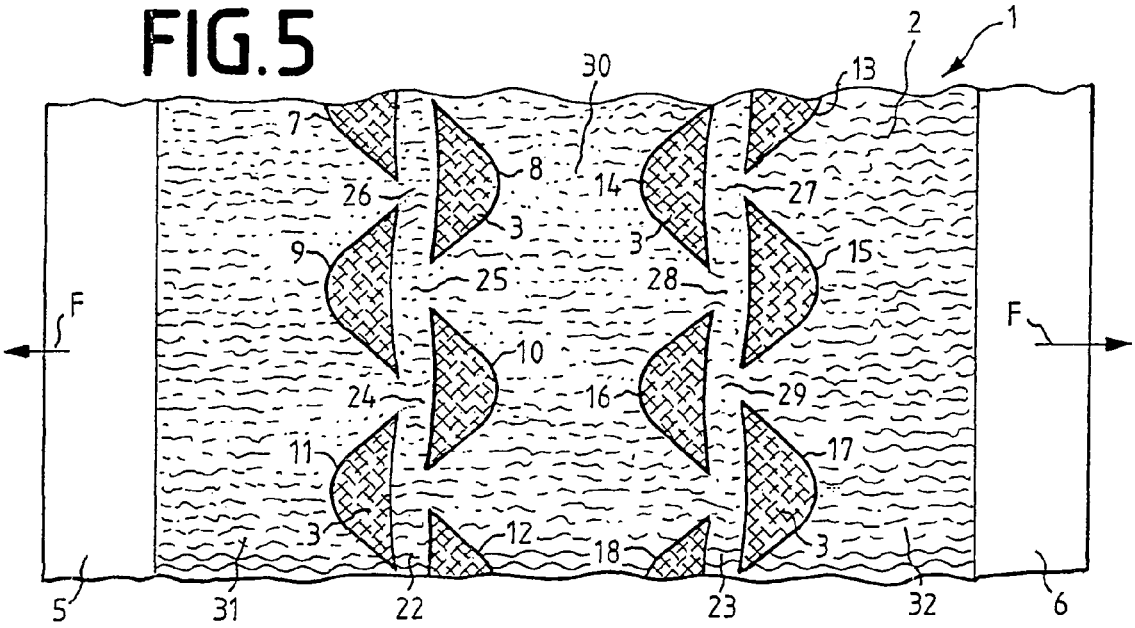
FIG. 5 the ridge strip according to FIG. 2 in a spread state.

FIG. 5 shows the ridge strip 1 in the same view as in FIG. 2, however, after force F has acted upon it. The nonseparated connection sites 22 to 29 are here located minimally higher than the middle portion 30 of the deformable component 2. Due to the lateral displacements of the side portions 31, 32 of the deformable component 2, the view onto the woven fabric 3 is exposed. The size of the exposed woven fabric 3 is a measure of the horizontal extension that has taken place.

Figure 6:
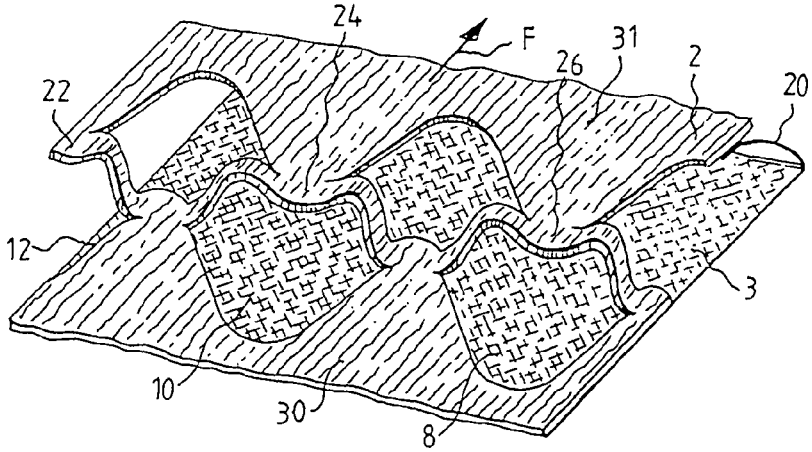
FIG. 6 a perspective view of a portion of the ridge strip depicted in FIG. 5, FIG. 7 a first variant of an extension pattern in the ridge strip, FIG. 8 a second variant of an extension pattern in the ridge strip, FIG. 9 a third variant of an extension pattern in the ridge strip.

FIG. 6 shows the left region of the ridge strip 1 illustrated in FIG. 5 in a perspective view. It can be seen that the side portion 31 of the deformable component 2 is located higher with respect to the woven fabric 3 than the central portion 30. The connection sites 22 to 29 form in effect the maxima of sinusoidal halfwaves.

Figure 7:
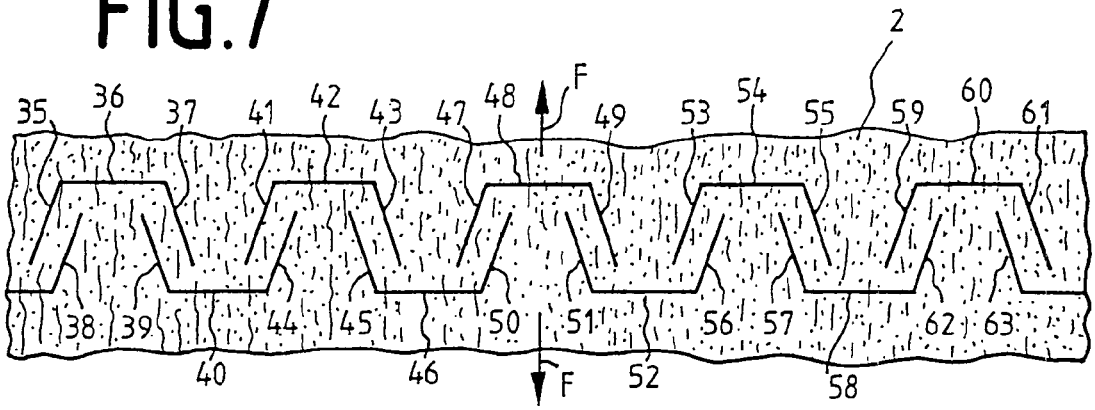

FIG. 7 shows a first variant of an extension pattern in a ridge strip. In contrast to the example of FIGS. 1 to 6, this extension pattern is not comprised of sinusoidal incisions but rather of trapezoidal incisions. The straight-line incisions 35 to 63 form here a meander pattern, which, under the action of a force F, effects a widening in the direction of force F. The trapezoidal incisions are incisions following the pattern of an isosceles trapezoid, whose legs 35, 37 and 41, 43 and 47, 49 and 53, 55 and 59, 61, respectively, are connected with the top 36 and 42 and 48 and 54 and 60, respectively, the [trapezoid] base being omitted.

The legs 41, 43 of an upper trapezoid extend parallel to the legs 45, 50 of a lower trapezoid and are directed toward its top 46.

Thereby that the greater base of the trapezoid is omitted, i.e. that no incision is provided corresponding to this base, the extension of the deformable component 2 in the direction of force F is possible.

Figure 8:
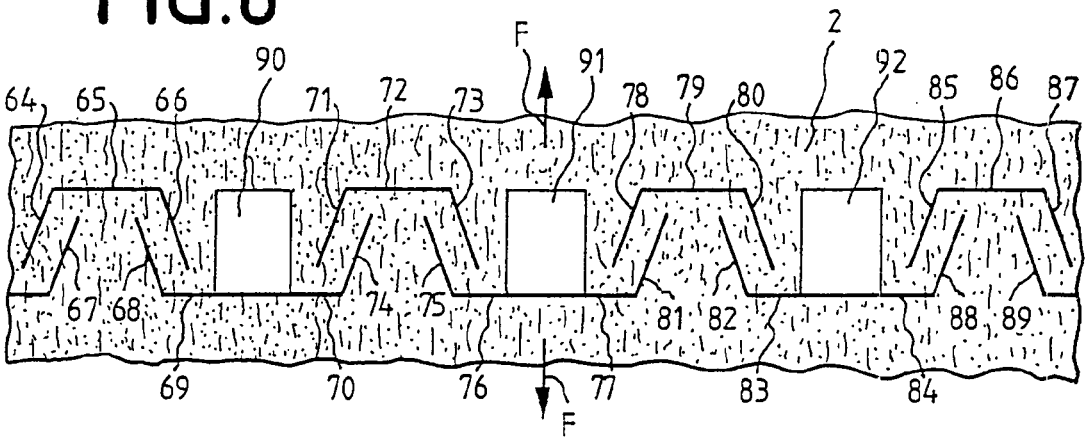

FIG. 8 shows a further variant of the extension pattern, which, in addition to incisions 64 to 89, has rectangular [vacant] spaces 90 to 92, no material being disposed at the sites of the spaces.

Figure 9:
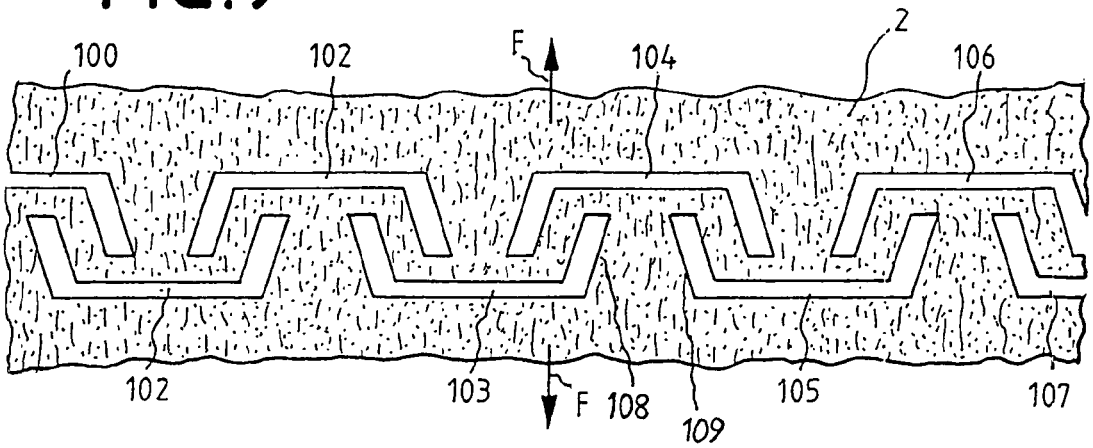

A further variant of the extension pattern is shown in FIG. 9. Instead of pure incisions, cutouts 100 to 107 are provided in the deformable component 2. These cutouts have the form of cross sections through truncated cones and are each offset by 180 degrees, such that the side walls 108, 109 project into the interior of the truncated cone 104. If a force F is exerted, component 2 is widened.

The invention claimed is:

1. A stretchable, substantially flat, level or sloping ridge strip comprising:

a length and a width being substantially shorter than said length;

a deformable component;

outer margin regions being configured to be disposed onto roofing members;

said deformable component comprising two sets of interrupted cut lines, disposed apart from one another, and each running along said length of said stretchable, substantially flat, level or sloping ridge strip;

said deformable component being configured and disposed to permit said width of said ridge strip to be stretched in the direction of said width by expansion of said cut lines in the width direction to provide compensation for unevenness in gaps between roofing members;

each of said cut lines comprising a first end point at a first end of each of said cut lines and a second end point at a second end of each of said cut lines; and the direction between said first end point and said second end point of each corresponding cut line being transverse to said width.

2. The ridge strip according to claim 1, including at least one of (A), (B), (C), and (D), wherein (A), (B), (C), and (D) comprise:

(A) said cut lines comprise portions of sinusoidal wave shapes;

(B) said deformable component comprises a center component configured to be disposed on the top side of said deformable component upon said ridge strip being disposed onto roofing;

(C) said deformable component comprises a peel-off film disposed on the bottom surface of said outer margin regions upon said ridge strip being disposed onto roofing; and (D) each of said cut lines comprises an elongated first side and an elongated second side; and at least a substantial portion of said elongated first side being immediately adjacent at least a substantial portion of said elongated second side prior to installation.

3. The ridge strip according to claim 1, including at least one of (A), (B), (C), and (D), wherein (A), (B), (C), and (D), comprise:

(A) said cut lines comprise portions of partial trapezoidal shapes with their base side omitted;

(B) said cut lines comprise portions of partial trapezoidal shapes with their base side omitted; and said portions of partial trapezoidal shapes comprise an isosceles trapezoidal shape;

(C) said cut lines comprise portions of partial trapezoidal shapes with their base side omitted;

said portions of partial trapezoidal shapes comprise:

two sides angled toward one another;

a top side connecting said two angled sides;

said portions of partial trapezoidal shapes comprise a first group and a second group; and said first group comprises top sides greater than top sides of said second group; and (D) said deformable component comprises open areas.

4. The ridge strip according to claim 1, including at least one of (A), (B), and (C), wherein (A), (B), and (C) comprise:

(A) said deformable component comprises a fabric configured to be disposed on the top side of said deformable component upon said ridge strip being disposed onto roofing;

(B) said deformable component comprises a fabric configured to be disposed on the top side of said deformable component upon said ridge strip being disposed onto roofing; and said fabric comprises loops configured and disposed to connect to said deformable component; and (C) said deformable component comprises a fabric configured to be disposed on the top side of said deformable component upon said ridge strip being disposed onto roofing; and said deformable component comprises a center component configured to be disposed on the top side of said fabric upon said ridge strip being disposed onto roofing.

5. A stretchable level or sloping ridge strip comprising:

a length, and a width being substantially shorter than said length;

a deformable component;

outer margin regions being configured to be disposed onto roofing;

said deformable component comprising two lines of interrupted disruptions in said stretchable level or sloping ridge strip; and said deformable component being configured and disposed to permit said width of said ridge strip to be stretched in the direction of said width by expansion of said disruptions in the width direction;

each of said interrupted disruptions comprising a first end point at a first end of each of said interrupted disruptions and a second end point at a second end of each of said interrupted disruptions; and the direction between said first end point and said second end point of each corresponding interrupted disruption being transverse to said width.

6. The ridge strip according to claim 5, including at least one of (A), (B), (C), (D), and (E), wherein (A), (B), (C), (D), and (E) comprise:

(A) said deformable component comprises two sets of interrupted disruptions, disposed from one another, and each running along said length of said stretchable, substantially flat, level or sloping ridge strip;

(B) said interrupted disruptions comprise portions of sinusoidal wave shapes;

(C) said deformable component comprises a center component configured to be disposed on the top side of said deformable component upon said ridge strip being disposed onto roofing;

(D) said deformable component comprises a peel-off film disposed on the bottom surface of said outer margin regions upon said ridge strip being disposed onto roofing; and (E) each of said interrupted disruptions comprises an elongated first side and an elongated second side; and at least a substantial portion of said elongated first side being immediately adjacent at least a substantial portion of said elongated second side prior to installation.

7. The ridge strip according to claim 5, wherein said interrupted disruptions comprise portions of partial trapezoidal shapes with their base side omitted.

8. The ridge strip according to claim 7, including at least one of (A), (B), (C), and (D), wherein (A), (B), (C), and (D) comprise:

(A) said portions of partial trapezoidal shapes comprise an isosceles trapezoidal shape;

(B) said portions of partial trapezoidal shapes comprise:

two sides angled toward one another;

a top side connecting said two angled sides;

said portions of partial trapezoidal shapes comprise a first group and a second group;

said first group comprise top sides greater than top sides of said second group;

(C) said deformable component comprises open areas; and (D) said interrupted disruptions comprise cut lines.

9. The ridge strip according to claim 5, including at least one of (A), (B), and (C), wherein (A), (B), and (C) comprise:

(A) said deformable component comprises a fabric configured to be disposed on the top side of said deformable component upon said ridge strip being disposed onto roofing;

(B) said deformable component comprises a fabric configured to be disposed on the top side of said deformable component upon said ridge strip being disposed onto roofing; and said fabric comprises loops configured and disposed to connect to said deformable component; and (C) said deformable component comprises a fabric configured to be disposed on the top side of said deformable component upon said ridge strip being disposed onto roofing; and said deformable component comprises a center component configured to be disposed on the top side of said fabric upon said ridge strip being disposed onto roofing.

10. A level or sloping ridge strip with a deformable component, which can be placed with its outer margin region onto roofings, wherein the deformable component (2) comprises two interrupted waveform cut lines (7 to 18, 35 to 63; 64 to 89, 100 to 107) extending in the opposite direction, and wherein each of said cut lines comprising a first end point at a first end of each of said cut lines and a second end point at a second end of each of said cut lines; and the direction between said first end point and said second end point of each corresponding cut line being transverse to the width of said ridge strip.

11. The level or sloping ridge strip as claimed in claim 10, wherein the cut lines (7 to 18) have the form of shortened sinusoidal halfwaves.

12. The level or sloping ridge strip as claimed in claim 10, wherein the cut lines (35 to 63) have the form of a trapezoid with the base side omitted.

13. The level or sloping ridge strip as claimed in claim 12, wherein the trapezoid is an isosceles trapezoid.

14. The level or sloping ridge strip as claimed in claim 12, wherein the one waveform cut line has a greater top side (69, 70, 76, 77, 83, 84) that the other waveform cut line, a cutout (90, 91, 92) being provided at the greater top side (69, 70; 76, 77; 83, 84) in the deformable component (2).

15. The level or sloping ridge strip as claimed in claim 10, wherein the deformable component (2) in its outer margin region of its bottom surface comprises a peel-off film (5,6).

16. The level or sloping ridge strip as claimed in claim 10, wherein the level or sloping ridge strip comprises a fabric (3) being disposed on the top side of the deformable component (2).

17. The level or sloping ridge strip as claimed in claim 16, wherein the fabric forms loops at its end, whose top sides are connected with the deformable component (2).

18. The level or sloping ridge strip as claimed in claim 16, wherein the level or sloping ridge strip comprises a center component (4) being connected to and disposed above the fabric (3).

19. The level or sloping ridge strip as claimed in claim 10, wherein the level or sloping ridge strip comprises a center component (4) being disposed above the deformable component (2).

* * * * *